US005697628A

United States Patent [19]

Spear

[11] Patent Number: 5,697,628

[45] Date of Patent: Dec. 16, 1997

[54] WHEELCHAIR EXERCISE AND SUPPORT BAR APPARATUS AND METHOD

[76] Inventor: Robert W. Spear, 3419 Holiday Ave., NE., Albuquerque, N. Mex. 87111

[21] Appl. No.: 701,810

[22] Filed: Aug. 21, 1996

Related U.S. Application Data

[60] Provisional application No. 60/002,738, Aug. 24, 1995.

[51] Int. Cl.[6] ..... A62B 35/00

[52] U.S. Cl. ..... 280/304.1; 280/47.36; 482/38; 297/411.36; 297/487

[58] Field of Search ..... 280/304.1, 250.1, 280/47.36, 748; 482/91, 38, 39; 297/411.36, 487, 488

[56] References Cited

U.S. PATENT DOCUMENTS

| | | | |
|---|---|---|---|
| 2,441,997 | 10/1948 | Faulkner | 155/22 |
| 2,556,121 | 6/1951 | Thomas | 155/22 |
| 2,596,055 | 5/1952 | Thomas | 280/304.1 |
| 2,603,499 | 7/1952 | Netzband | 280/47.36 X |
| 3,619,005 | 11/1971 | Hardy | 297/488 |
| 3,635,526 | 1/1972 | Posey | 297/488 |
| 3,708,182 | 1/1973 | Markiel | 280/289 |
| 4,280,731 | 7/1981 | Pitts et al. | 297/487 |
| 4,613,994 | 9/1986 | Oates | 280/304.1 X |
| 4,759,562 | 7/1988 | Vinyard et al. | 280/289 WC |
| 4,948,156 | 8/1990 | Fortner | 280/304.1 |
| 5,257,799 | 11/1993 | Cone et al. | 280/47.36 X |
| 5,294,027 | 3/1994 | Plastina | 280/304.1 X |

*Primary Examiner*—Victor E. Johnson

*Attorney, Agent, or Firm*—Deborah A. Peacock; D. Goelet Kehl; Jeffrey D. Myers

[57] ABSTRACT

An exercise and support bar apparatus mounted in brackets on a wheelchair and method for using same. The bar can be adjusted to be more or less proximate the occupant by removing the upstanding portions of the bar from the brackets, turning the apparatus end-for-end, and re-inserting the upstanding portions in the bracket. Angular and height adjustments are also provided by the apparatus.

25 Claims, 3 Drawing Sheets

WHEELCHAIR EXERCISE AND SUPPORT BAR APPARATUS AND METHOD

CROSS-REFERENCE TO RELATED APPLICATIONS

This application claims the benefit of the filing date of Provisional application Ser. No. 60/002,738, entitled "Wheelchair Exercise and Support Bar," to Robert W. Spear, filed on Aug. 24, 1995.

BACKGROUND OF THE INVENTION

1. Field of the Invention (Technical Field)

The present invention relates to an exercise and support bar reversibly mountable on a wheelchair.

2. Background Art

Many devices have been invented to provide exercise and diversion for wheelchair-bound disabled or physically challenged persons.

U.S. Pat. No. 3,708,182, to Markiel, entitled "Combination Wheelchair and Walker," discloses a wheel chair and walker combination. The walker comprises a single wheel and a frame attachable to the wheelchair.

U.S. Pat. No. 4,759,562, to Vinyard, et al., entitled "Walker Conversions for Wheel Chairs," discloses a structure for converting a wheelchair into a walker. The structure includes a seat and an inverted U-bar which can be grasped by the occupant.

U.S. Pat. No. 4,948,156, to Fortner, entitled "Standing Lift and Support for Wheelchair User," discloses a complex frame attachable to a wheelchair. The device features occupant hoisting means and bracer for supporting the occupant.

U.S. Pat. No. 2,556,121, to Thomas, entitled "Detachable Wheel Chair Walking Apparatus," discloses a walker which attaches to a wheelchair with clamps. U.S. Pat. No. 2,441,997, to Faulkner, entitled "Wheel Chair Attachment," discloses a similar device attachable to a wheelchair axle with cotter pins.

These prior art devices are collectively cumbersome and exist mainly to assist persons in standing and walking. However, for those wheelchair occupants for whom standing and walking may not be advisable, yet who also require some exercise and diversion, the prior art provides few alternatives.

SUMMARY OF THE INVENTION (DISCLOSURE OF THE INVENTION)

The present invention is a wheelchair exercise and support bar comprising: support brackets; tubular upstanding portions mounted in the support brackets; each of the tubular upstanding portions comprising a straight portion and a curved portion; one of the curved portions being joined to the other curved portion, forming the exercise and support bar; and wherein mounting the upstanding portion in the brackets provides a first configuration of the exercise and support bar while reversibly mounting the upstanding portion in the brackets provides a second configuration of the exercise and support bar. In the preferred embodiment, the support brackets are mounted on a wheelchair, and either fixed or pivotable. The tubular upstanding portions nest in telescoping relationship, are adjustable for height, and are angularly adjustable (either by a ratchet-and-pawl mechanism or pivotable support brackets). The exercise and support bar is laterally adjustable, preferably by means of one of the curved portions telescopically nesting within the other curved portion. The exercise and support bar is preferably encircled with padding material.

The invention is also a method of using a wheelchair-mounted exercise and support bar comprising: inserting the exercise and support bar in brackets and thereby providing a first configuration of the exercise and support bar relative to an occupant; removing the exercise and support bar from the brackets; turning the exercise and support bar end-for-end; and re-inserting the exercise and support bar in the brackets and thereby providing a second configuration of the exercise and support bar relative to the occupant. Angular, vertical, and lateral adjustments are preferable, and a padded cover is best provided for the exercise and support bar.

A primary object of the present invention is the provision of an exercise bar on the front of a wheelchair.

Another object of the invention is the provision of a handhold on a wheelchair permitting the occupant to shift his weight.

Yet another object of the invention is the provision of a restraint for preventing persons from falling from their wheelchairs.

Still another object of the invention is the provision of a stable platform for enabling wheelchair occupants to carry small objects.

A primary advantage of the present invention is the reversibility.

Another advantage of the invention is its adjustability in several degrees of freedom.

Yet another advantage of the invention is the provision of support, thereby tending to eliminate bed sores.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODE FOR CARRYING OUT THE INVENTION)

Figure 1:
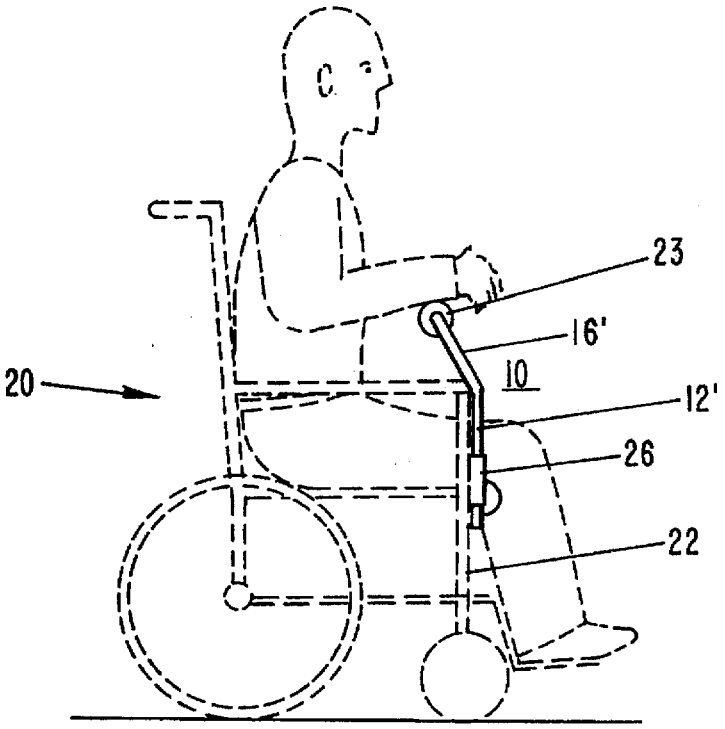
FIG. 1 is a side perspective view with the exercise bar of the invention in a first position.
Figure 2:
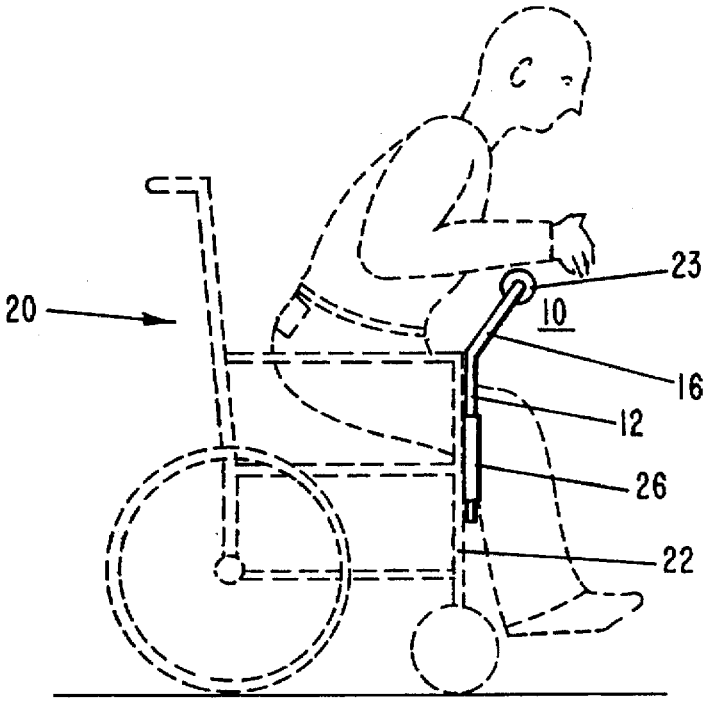
FIG. 2 is a side perspective view of the invention with the exercise bar of the invention in a second position.
Figure 3:
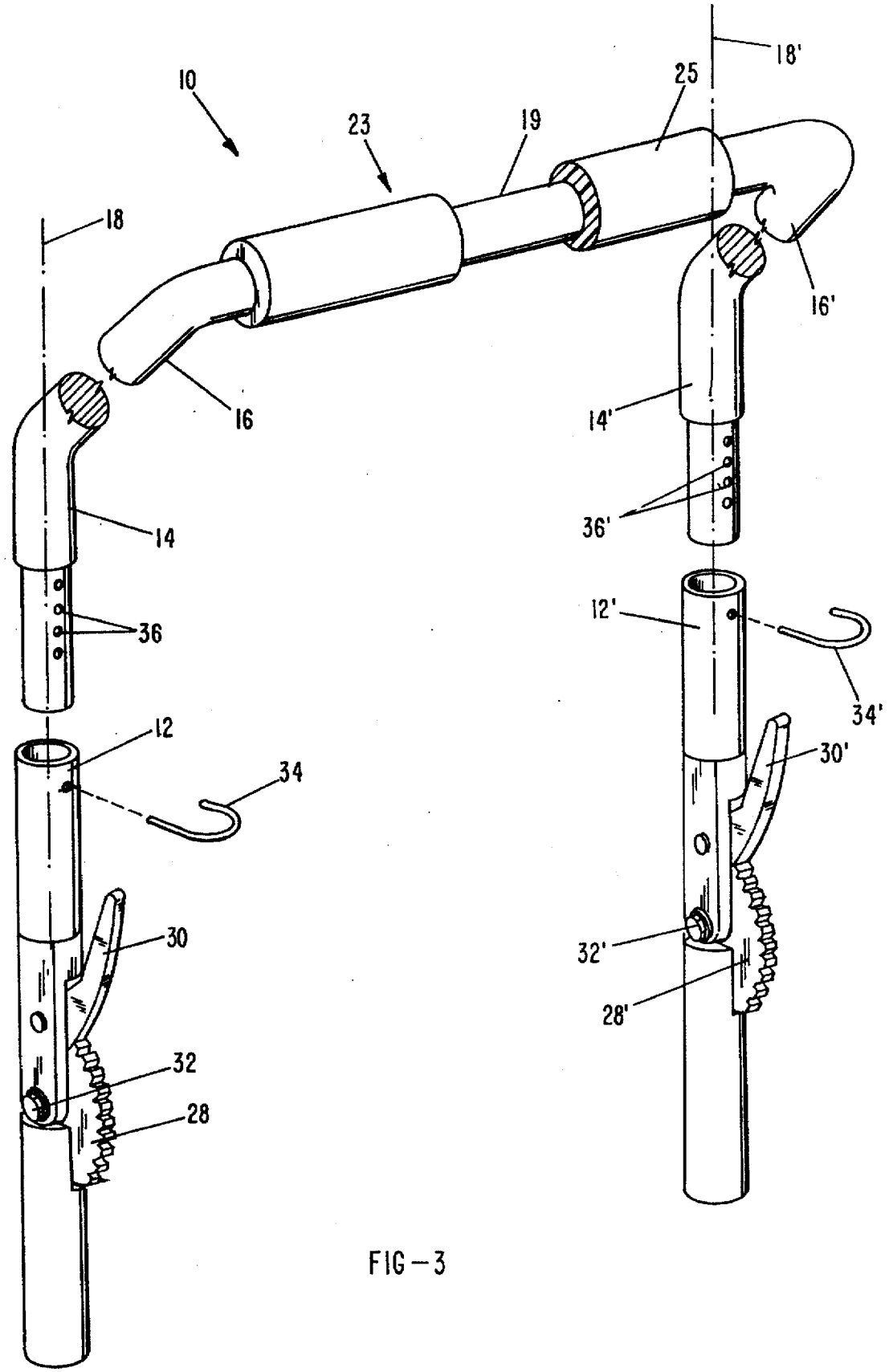
FIG. 3 is an view of the exercise bar of the invention in an articulated layout.

FIGS. 1, 2 and 3 depict the exercise bar 10 apparatus of the invention mounted to conventional wheelchair 20. Exercise bar apparatus 10 preferably comprises stainless steel tubular stock and further comprises two upstanding tubular portions 12,12'. Each upstanding tubular portion 12,12' further comprises a straight portion 14,14' comprising at least two tubular sections and a curved portion 16,16' inclined to the axis 18/18' of the straight portion 14,14'. Curved portions 16,16' telescope together at 19 in interference fit permitting lateral adjustment. Curved portion 16, being slightly larger in diameter than curved portion 16' slides over curved portion 16' forming an inverted U-shaped cross piece 23. Cross piece 23 is covered with an elastomeric cylinder 25, which may also be of padded, quilted or any other soft construction known to the art.

As clearly shown in FIGS. 1 and 2, upstanding portions 12,12' are mounted in brackets 26 which may be bolted, screwed, welded or otherwise secured to the legs 22 of wheelchair 20. Brackets 26 may also be of tubular configuration, bottomed, and having a slightly larger diameter than upstanding portions 12,12'.

Accordingly, one position for the exercise bar is shown in FIG. 1 where cross piece 23 is inwardly positioned toward the occupant. This position allows the occupant to rest his or her arms or other objects on cross piece 23.

To achieve the configuration shown in FIG. 2, apparatus 10 is merely withdrawn upwardly from brackets 26, turned end-for-end, and reinserted in brackets 26. This exercise bar configuration permits the occupant to partially rise from the wheelchair and otherwise shift his or her weight therein, thereby contributing to healing and prevention of bed sores.

The exercise bar apparatus 10 also presents several degrees of adjustability. For example, the telescoping of curved portions 16,16' at 19 automatically compensates for wheelchairs of various widths.

The angle of inclination of upstanding portions 12,12' may also be adjusted by stationary ratchets 28,28' and movable pawls 30,30'. Disengaging spring-loaded pawls 30,30' by squeezing enables pivotal motion about pivots 32,32'. At the desired angle of inclination, the pawls 30,30' is released, re-engaging ratchets 28,28', thereby locking upstanding portions 12,12' in position.

Another adjustability feature of the invention is adjustment of the height of upstanding portions 12,12'. This may be simply and positively accomplished by insertion of cotter pins 34,34' in adjustment holes 36,36'. The area about holes 36,36' may be color coded or otherwise indexed so that the tubular sections upstanding portions 12,12' are evenly and equally displaced. Cotter pins 34,34' may be secured to upstanding portions 12,12' by a spot welder or the like.

Figure 4:
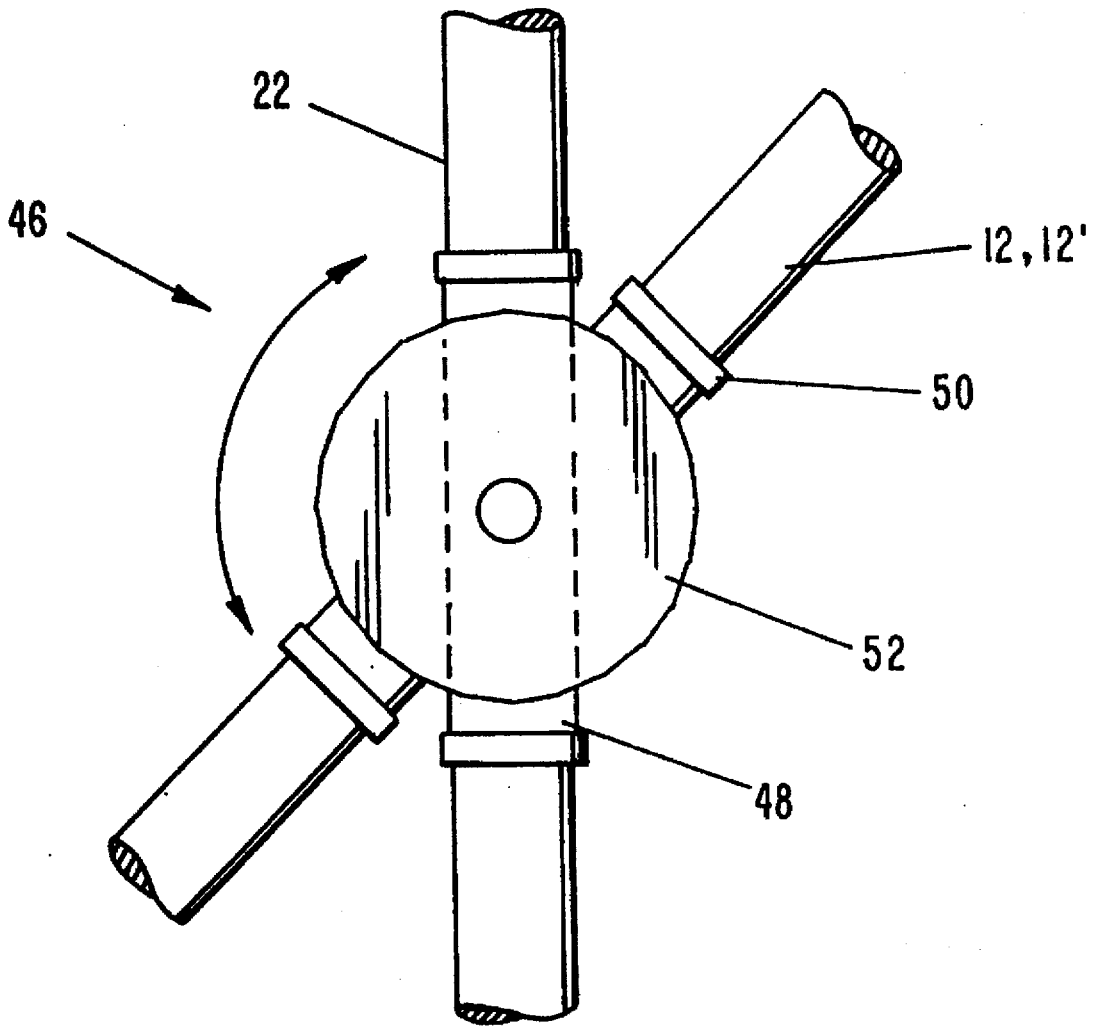
FIG. 4 shows another embodiment of the support bracket.

FIG. 4 shows another support bracket 46 which is angularly adjustable. Bracket 46 comprises two portions: one portion 48 is secured to wheelchair leg 22 and portion 50 secured to upstanding, portion 12,12'. Adjustment knob 52 permits angular adjustment of upstanding portions 12,12' relative to wheelchair legs 22 the other loosening the knob for adjustment and tightening in position. This angular adjustment feature provides an alternative to the ratchet-and-pawl adjustment of FIG. 3.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. A wheelchair-mounted exercise and support bar apparatus the wheelchair having a front side and first and second legs positioned at the front side of the wheelchair, comprising:

first and second tubular upstanding portions, each of said first and second tubular upstanding portions having first and second top and bottom ends, respectively, each of said bottom ends comprising a straight portion and each of said top ends comprising a curved portion inclined at an angle to axes of said straight portions, said curved portions of said first and second top ends extending horizontally toward each other to nest in telescoping relationship, thereby forming a substantially inverted U-shaped cross piece displaced at an angle from the axes of said straight portions;

first and second support brackets providing a mount for said first and second tubular upstanding portions, respectively, said brackets being removably attached to the first and second legs of the wheelchair; and means for reversibly mounting said tubular upstanding portions to provide said cross piece either inwardly angled toward or outwardly angled from the wheelchair.

2. The apparatus of claim 1 wherein said first and second support brackets are fixed.

3. The apparatus of claim 1 wherein said first and second support brackets are pivotable.

4. The apparatus of claim 1 wherein each of said first and second support brackets comprises a tubular configuration having a bottom and a diameter larger than diameters of each of said first and second bottom ends of each of said first and second tubular upstanding portions, and each of said first and second bottom ends of each of said first and second tubular upstanding portions nest in telescoping relationship inside said first and second support brackets respectively.

5. The apparatus of claim 4 wherein said first and second tubular upstanding portions are vertically adjustable for height.

6. The apparatus of claim 4 wherein said first and second tubular upstanding portions are angularly adjustable.

7. The apparatus of claim 6 wherein said first and second tubular upstanding portions are angularly adjustable by means of a ratchet-and-pawl mechanism.

8. The apparatus of claim 6 wherein said first and second tubular upstanding portions are angularly adjustable by means of vertically pivotable support brackets.

9. The apparatus of claim 1 wherein said exercise and support bar apparatus is laterally adjustable by means of slidably extending said telescopically nesting curved portions.

10. The apparatus of claim 1 wherein said exercise and support bar apparatus is laterally adjustable by means of slidably retracting said telescopically nesting curved portions.

11. The apparatus of claim 1 wherein said exercise and support bar apparatus is encircled with padding material.

12. The apparatus of claim 1 wherein said first and second tubular upstanding portions are mounted in said first and second brackets to provide said cross piece angled inwardly toward the wheelchair, whereby an occupant can rest against said cross piece without falling.

13. The apparatus of claim 1 wherein said first and second tubular upstanding portions are mounted in said first and second brackets to provide said cross piece angled outwardly away from the wheelchair, whereby an occupant can partially rise from the wheelchair.

14. The apparatus of claim 1 wherein each of said first and second support brackets comprises a tubular configuration having a bottom and a diameter larger than diameters of each of said first and second bottom ends of each of said first and second tubular upstanding portions, and each of said first and second bottom ends of each of said first and second tubular upstanding portions are mounted by insertion inside said first and second support brackets, respectively.

15. The wheelchair-mounted exercise and support bar apparatus of claim 1, wherein each of said first and second support brackets comprises at least two portions, one of said portions secured to the wheelchair and the other of said portions secured to one of said first and second tubular upstanding portions, and further comprising knob means for angularly adjusting and locking said tubular upstanding portions into a desired position.

16. A method of using a wheelchair-mounted exercise and support bar apparatus, the wheelchair having a front side and first and second legs positioned at the front side of the wheelchair, and the exercise and support bar apparatus having first and second support brackets mounted on the first and second legs of the wheelchair and comprising a substantially inverted U-shaped cross piece having two legs and a curved portion inclined at an angle to the axes of the two legs, said method of using comprising the steps of:

a) inserting the legs of the cross piece of the exercise and support bar apparatus into the first and second support brackets to provide a first configuration of the exercise and support bar apparatus angled inwardly relative to the wheelchair, whereby an occupant can rest against the crosspiece without falling;

b) removing the exercise and support bar apparatus from the brackets;

c) turning the exercise and support bar apparatus end-for-end; and d) re-inserting the legs of the cross piece of the exercise and support bar apparatus in the first and second brackets to provide a second configuration of the exercise and support bar apparatus angled outwardly relative to the wheelchair, whereby the occupant can partially rise from the wheelchair.

17. The method of claim 16 further comprising the step of angularly adjusting the exercise and support bar apparatus.

18. The method of claim 16 further comprising the step of vertically adjusting the exercise and support bar apparatus.

19. The method of claim 16 further comprising the step of laterally adjusting the exercise and support bar apparatus.

20. The method of claim 16 further comprising the step of providing a padded cover for the exercise and support bar apparatus.

21. A wheelchair-mounted exercise and support bar apparatus, the wheelchair having a seat, a front side, and at least two front legs, said apparatus comprising:

cross piece means horizontally and transversely disposed parallel the seat and on the front side of the wheelchair, wherein said cross piece means comprises at least two horizontal sections, each having first and second ends, said first ends of said sections telescoping in interference fit at a point between said second ends of said sections;

at least two vertical means for connecting said cross piece means to said wheelchair, each of said connecting means extending vertically downward from each of said second ends of said cross piece means and comprising a curved portion proximal to said cross piece means and a straight portion proximal to the wheelchair, said curved portion being inclined at an angle to an axis of said straight portion, whereby said cross piece means is placed into an angularly inclined position relative to said front legs of the wheelchair to allow an occupant of the wheelchair to either lean forward and grasp said cross piece means or to rest against said cross piece means; and means for reversing position of said apparatus to provide said cross piece either inwardly angled toward or outwardly angled from the wheelchair.

22. The wheelchair-mounted exercise and support bar apparatus of claim 21, wherein said cross piece means is disposed in a forwardly inclined position relative to the wheelchair for allowing the occupant of the wheelchair to lean forward and grasp said cross piece means.

23. The wheelchair-mounted exercise and support bar apparatus of claim 21, wherein said cross piece means is disposed in a backwardly inclined position relative to the wheelchair for allowing the occupant of the wheelchair to rest on said cross piece.

24. The wheelchair-mounted exercise and support bar apparatus of claim 21, further comprising vertically pivotal means for mounting each of said straight portions to the front legs of the wheelchair.

25. The wheelchair-mounted exercise and support bar apparatus of claim 24, further comprising means for locking said vertically pivotal means into a desired position.

* * * * *